United States Patent [19]

Griffin et al.

[11] Patent Number: 4,821,884

[45] Date of Patent: Apr. 18, 1989

[54] SECONDARY PACKAGING

[75] Inventors: Christopher Griffin, London; Peter Kay, Shefield, both of United Kingdom

[73] Assignee: General Foods Limited, Banbury, England

[21] Appl. No.: 119,944

[22] Filed: Nov. 12, 1987

[51] Int. Cl.[4] ..... B65D 1/34

[52] U.S. Cl. ..... 206/557; 206/45.14; 206/621; 206/626; 229/40; 229/902; 229/903; 229/904; 229/906; 426/119

[58] Field of Search ..... 206/45.14, 45.31, 45.32, 206/557, 621, 624, 633, 626; 229/40, 87 F, 902, 904, 906, 903; 426/107, 110, 119, 122

[56] References Cited

U.S. PATENT DOCUMENTS

| | | | |
|---|---|---|---|
| 2,745,752 | 5/1956 | Peters | 426/119 |
| 2,813,624 | 11/1957 | Phipps | 206/626 |
| 2,993,590 | 7/1961 | Denton | 206/462 |
| 3,183,100 | 5/1965 | Bonini | 206/45.31 |
| 3,349,985 | 10/1967 | Salway | 206/557 |
| 3,530,917 | 9/1970 | Donovan | 426/119 |
| 3,793,135 | 2/1974 | Monia | 426/119 |
| 3,899,119 | 8/1975 | Roccaforte | 426/119 |
| 4,013,798 | 3/1977 | Goltsos | 426/107 |
| 4,183,458 | 1/1980 | Meyers | 206/626 |
| 4,202,465 | 5/1980 | McLaren | 229/903 |
| 4,221,320 | 9/1980 | Faller | 229/40 |
| 4,463,893 | 8/1984 | Brunone et al. | 206/633 |
| 4,661,671 | 4/1987 | Maroszek | 426/107 |
| 4,671,453 | 6/1987 | Cassidy | 229/40 |
| 4,716,061 | 12/1987 | Winter | 426/107 |

FOREIGN PATENT DOCUMENTS

| | | | |
|---|---|---|---|
| 508205 | 12/1954 | Canada | 229/904 |

*Primary Examiner*—David T. Fidei

*Attorney, Agent, or Firm*—Linn I. Grim; Daniel J. Donovan

[57] ABSTRACT

In this invention, there is provided a combination of a heat resistant container containing a ready prepared meal and a secondary package providing support for the container and restricting the flow of hot air back to the container.

15 Claims, 4 Drawing Sheets

1
2
3
4
5
6
7
8
9
9
12
13
14
15
16
17
18
19
3

SECONDARY PACKAGING

BACKGROUND OF THE INVENTION

The present invention relates to secondary packaging and, in particular, to secondary packaging for containers which contain ready prepared meals.

Ready prepared meals are produced in aluminium foil or heat resistant plastic trays. The meal is cooked initially in the tray or inserted in the tray after an initial cooking stage. After this initial cooking, secondary packaging is then required so that the tray can be handled for distribution to and sale by the retail outlet.

It is known that plastics trays, such as those made from polyethylene treated by exposure to high energy electron or electromagnetic irradiation to increase its resistance to heat exposure, or those made from polypropylene, are generally only suitable for use as trays for ready prepared meals which are to be reheated by boiling or by microwave heating, since they tend to soften at temperatures of above 160° C. The softening is particularly noticeable around the rim of such a tray which on being heated in a conventional oven, such as a fan oven, will tend to distort and crumple around the rim thus becoming wavy and very unattractive.

There thus exists a need for a plastics tray that can be packaged in a manner such that it can be heated in a conventional oven to temperatures in the range of from 160° to 250° C., or even greater without the rim or body of the tray either crumpling or collapsing.

One proposal for improving the heat resistance of a tray made from polyethylene which has been exposed to high energy electron or electromagnetic irradiation to increase its resistance to heat exposure, is to surround a tray made from the material with a blank to which the tray is joined at certain points, for example by gluing the blank to the underneath of the rim of the tray. The assembly of these trays and their protective blanks is thus a relatively time consuming operation which requires to be carried out very precisely if acceptable tray and blank assemblies are to be obtained.

We have now developed a secondary package for a container which contains a ready prepared meal, which does not suffer from the above disadvantages.

SUMMARY OF THE INVENTION

Accordingly, the present invention provides a heat resistant container suitable for a ready prepared meal, which comprises a tray having a bottom, side walls, a rim and a removable or openable lid or cover, the said tray being located in a recess provided in a secondary package, at least a substantial portion of the rim thereby being supported by the portion of the body of the secondary package surrounding the recess, and the secondary package also having a plurality of flanges depending from the recess opening which bear upon the side walls of the tray.

The rim of the tray is preferably fully supported underneath the whole of its length by the portion of the body of the secondary package surrounding the recess. The secondary package preferably has two pairs of opposed flanges depending from the recess opening. The flanges bear upon the outer surfaces of the side walls of the tray and thereby protect the side walls from heat.

The tray of the present invention may be manufactured from any heat-resisting thermoplastics material, such as polypropylene, which normally softens at a temperature of about 160° C., cross-linked polyethylene which has been formed by exposure of polyethylene to high energy electron or electromagnetic irradiation to increase its resistance to heat exposure, or a multilayer material such as one based on polypropylene or one based on cross-linked polyethylene with the inclusion of an intermediate barrier layer. In addition, other suitable materials include crystalline polyester and a co-extruded product comprising layers of crystalline polyester and amorphous polyester—these materials are known to have a high temperature resistance of up to 220° to 250° C., or higher. The secondary package provides support to the tray both underneath the rim and in the side wall area. When the container of the present invention is heated in a conventional oven, for example a fan oven, the support given to the tray prevents the tray from distorting and thus enables the tray to be heated at a temperature in the range of from 160° to 250° C. The secondary package also restricts the flow of hot air to the rim and side walls of the tray and thus also assists in preventing deformation of the tray.

The tray is provided with a removable or openable lid. The lid may be, for example, a foil or plastics lid which may be heat sealed to the rim of the tray. The lid may be removed or opened before cooking, if this is the operation recommended, or after cooking if it is preferred to heat the contents of the tray with the lid in position.

The secondary package is preferably made from an ovenable board, for example cardboard having a heat-resisting film coated thereon or bonded thereto for example a film of polyester or polyetherimide. Suggested board thicknesses could be from 0.5 to 0.7 millimetres. It is also possible to form the secondary package from a foldable and heat resistant solid plastics materials.

DESCRIPTION OF THE PREFERRED EMBODIMENTS

In a preferred embodiment of the present invention the secondary package is provided with a hinged lid which enclosed the top surface of the tray and the contents thereof during distribution to and sale by the retail outlet. The hinged lid of the secondary package can be readily opened by the consumer and easily folded back into the open position. The hinged lid is preferably designed so that it will remain in the open position. Both the top and underneath surfaces of the lid provide large uninterrupted areas which can be used for information display or graphic design. It is also preferred for the hinged lid to be provided with means to enable it to be locked back into the secondary package to provide a splashguard which is raised above the surface of the contents of the tray. This is particularly advantageous since as the contents of the tray are reheated in a microwave oven or conventional oven they are liable to splash as they boil. The splashguard provided by locking the hinged lid back into the secondary package thus prevents the microwave or conventional oven becoming unduly messy.

If desired, the secondary package may also comprise a base portion which surrounds the bottom of the tray. In this embodiment there will preferably be an air gap between the bottom of the tray and the base of the secondary package. Preferably the ends of the secondary package will be open, the open sleeve-like ends thus providing advantageous carrying points for carrying the container to and from the oven.

The trays in the containers of the present invention can be reheated in a microwave oven, in a conventional oven or by boiling. To reheat them in a microwave oven the tray, together with the secondary package, will be placed in the oven for the recommended period of time with the hinged lid of the secondary package acting as a splashguard. The lid of the tray will either be removed before cooking or after cooking, depending upon the instructions given. For reheating by boiling, the tray with the food contents will be removed from the secondary package and placed in boiling water for the recommended period of time. The secondary package of the present invention enables the tray to be removed easily therefrom either before cooking when the contents of the tray are to be reheated by boiling or after cooking if it is desired to remove the tray from the secondary package. This can be achieved by pressing down upon the surface of the secondary package surrounding the recess into which the tray is fitted. On the application of such pressure the secondary package is designed so as to become substantially flat and as the flanges depending from the recess are flattened they cause the tray to be quickly released.

Alternatively, in the situation where the tray is not desired to be removed from the secondary package prior to consumption of the contents of the tray, the secondary package provides a convenient means of transporting the heated tray to the location where the contents are to be consumed and provides support to the tray during eating.

BRIEF DESCRIPTION OF THE DRAWINGS

The present invention will be further described with reference to the accompanying drawings, in which:

Referring to FIGS. 1 and 2 of the drawings, the container 1 comprises a tray 2, formed for example from polypropylene, the tray having side walls 3, a bottom 4, a rim 5 and a removable or openable lid 6. The tray is filled with a ready prepared meal, for example cauliflower cheese or pasta in an appropriate sauce, as depicted generally at 7. The tray is located in a secondary package 8 which has a recess in which the tray 2 is located. The secondary package has a portion 9 surrounding the recess which provides support to the rim of the tray 5. The secondary package is also provided, as shown in FIG. 2, with two pairs of opposed flanges 10 which depend from the recess opening. The flanges 10 bear upon the side walls 3 of the container.

The secondary package is constructed from a single piece of cardboard which is shown as a blank in FIG. 3 of the Drawings. Crease lines are shown on the blank as partially broken lines. A glue strip is shown at 11 on FIG. 3. To construct the secondary package the cardboard blank is folded along the crease lines and the glue strip 11 affixed to side wall 12 of the secondary package. At this point during the assembly of the container of the invention the secondary package has a recess formed in the top surface thereof surrounded by portion 9. The tray containing the ready prepared meal is then dropped into the recess, thus causing the flaps 10 to bend along their crease lines and bear against the side walls 3 of the tray. The tray is provided with a lid 13 which is free to pivot around crease line 14. The lid is provided with a flap 15 which has a tongue 16 protruding therefrom. In the assembly of the container, for handling in distribution to and sale by an appropriate retail outlet, the flap and tongue portion of the lid will be affixed, for example by gluing, to side wall 17 of the secondary package. When it is desired to open the package the consumer's fingers can be inserted into indent 18 provided in the side wall 17 of the secondary package, thus enabling the user to lever up flap 16 and release the lid. In FIG. 2 the lid 13 is shown locked into position above the contents of the tray. This is effected by means of tongue 16 cooperating with a slot 19 provided in the upper surface of the secondary package adjacent the recess. When the contents of the tray have been appropriately heated, the tongue 16 can be simply but safely released from from the groove 19 and the lid hinged open. The lid remains in the open position not only by virtue of the pivot about crease line 14 but also because the glue strip 11 is only attached to the bottom portion of side wall 12 and a further crease line at the top of the glued portion ensures that the hinged lid can swing well away from the side wall 12. The base 20 of the secondary package is spaced apart from the bottom 4 of the tray, the tray thus being supported by upper surface 9 and flanges 10 of the secondary package, but not by the base thereof.

An alternative type of container in accordance with the invention is shown in FIGS. 4 and 5 of the accompanying drawings. Referring to FIGS. 4 and 5, a container 21 comprises a tray 2 having side walls 3, a bottom 4 and a rim 5. The tray is filled with a ready prepared meal as shown generally at 7. The secondary package has a recess in which the tray 2 is located. The secondary package has a portion 9 surrounding the recess which provides support to the underneath portion of the rim 5. The secondary package is also provided with two pairs of opposed flanges 10 which bear against the side walls 3 of the tray. The secondary package is provided with a double thickness top portion, the lower thickness providing the portion 9 which supports the tray 2 underneath its rim 5. The upper thickness of the top portion has a lid 22 formed therein. The lid is provided with a finger tab 23.

Figure 5:
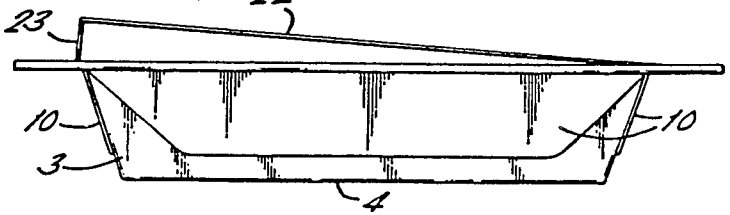
FIG. 5 is a side view of the container of FIG. 1 with the hinged lid resting above the tray.
Figure 6:
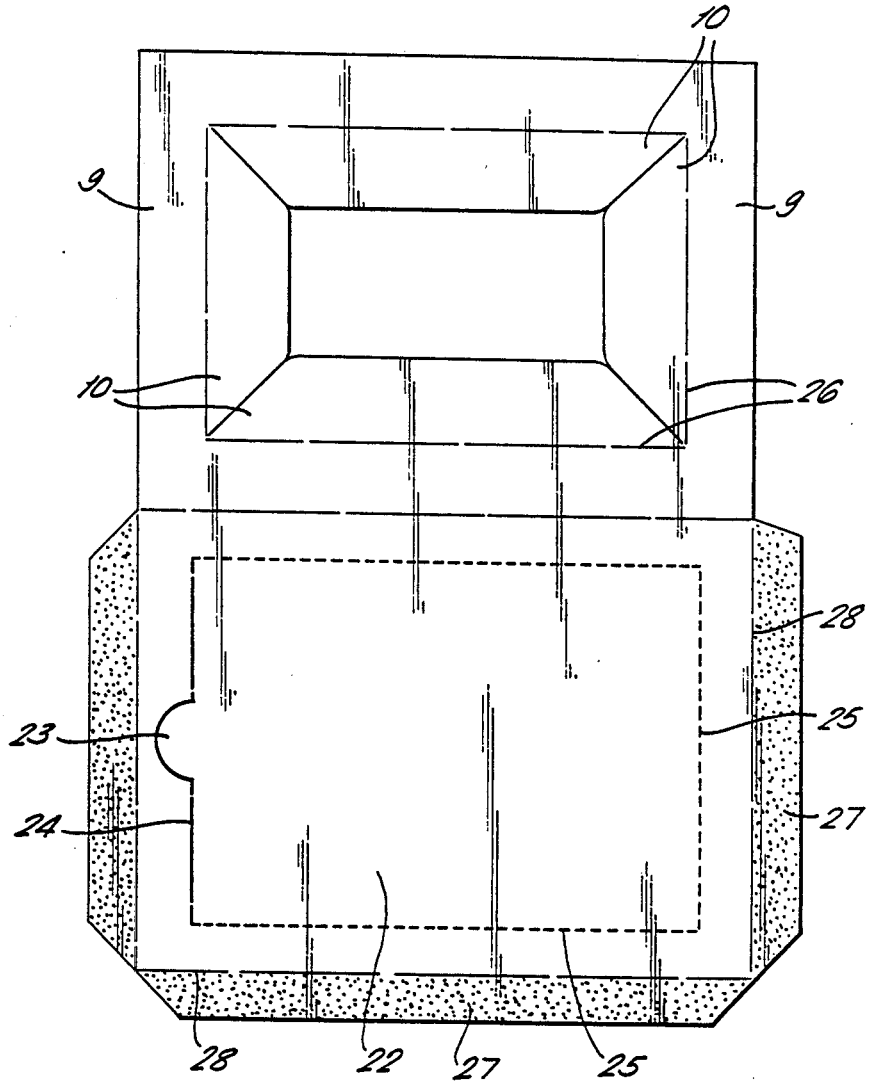
FIG. 6 is a plan view of the blank used to form the secondary package of the container of FIG. 4.

As best shown with reference to FIG. 6 of the accompanying drawings, which depicts a blank used in the formation of the secondary tray, the lid is partially cut through along one side 24 and provided with perforations 25 along the three remaining sides. The secondary package can be opened by pressing on the finger tab 23, thereby causing the final points of connection along side 24 to rupture and then tearing along the perforations 25 on the two longitudinal sides of the lid. If desired, the lid may be fully removed by tearing along the perforations 25 on the remaining transverse edge thereof. The finger tab 23 may, if desired, be bent down by the consumer and used to prop open the container by placing the tab on surface 9. This is shown in FIG. 5.

Figure 1:
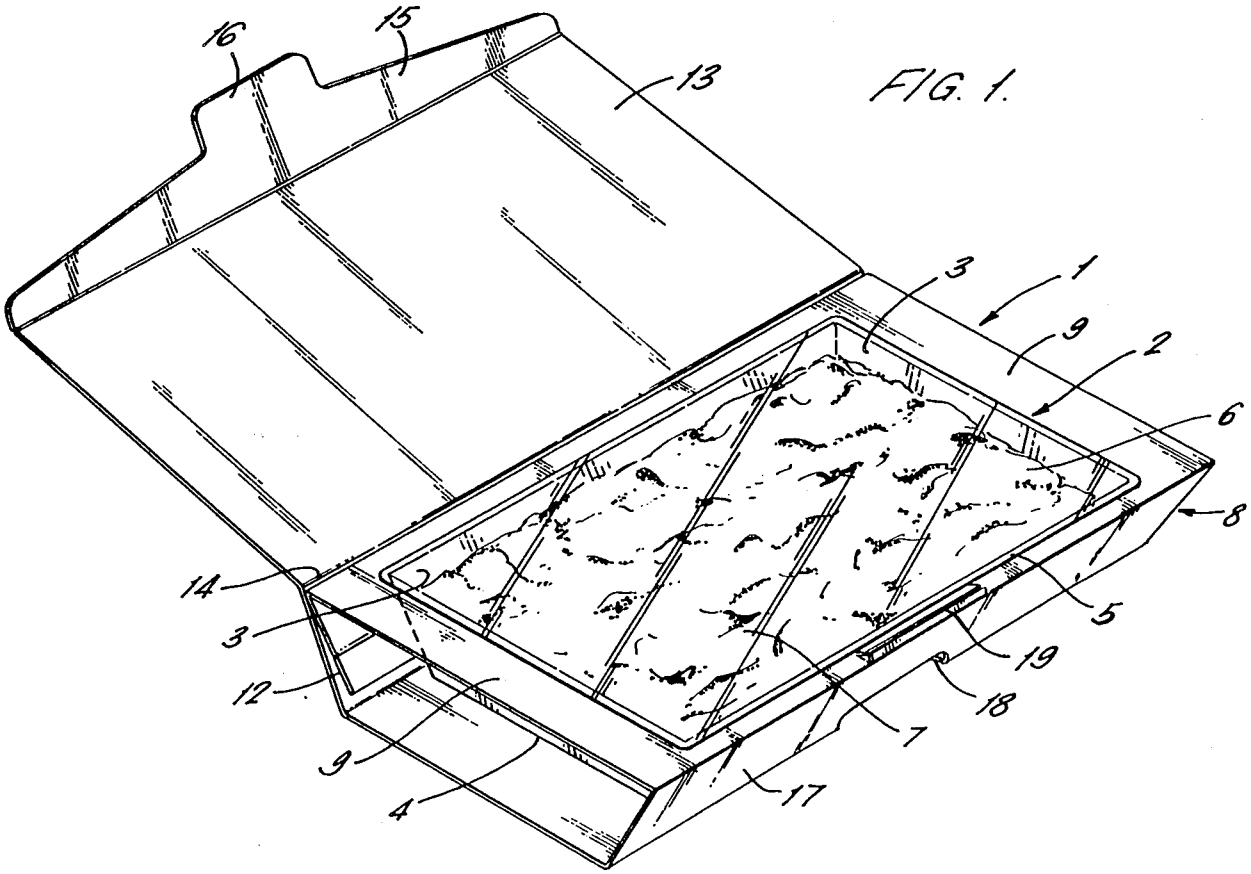
FIG. 1 is a perspective view of one type of container of the present invention with a hinged lid in the open position.
Figure 2:
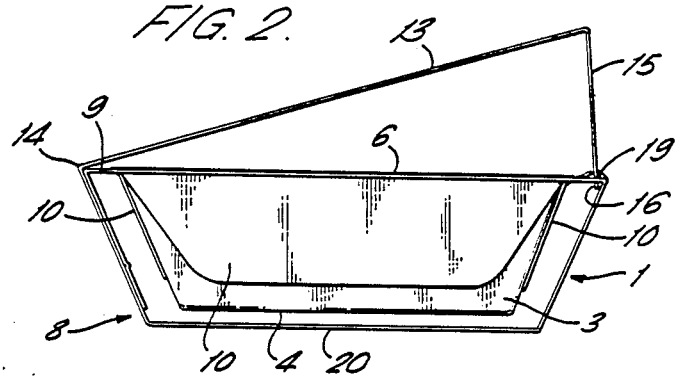
FIG. 2 is a side view of the container of FIG. 1 with the hinged lid locked into position.
Figure 3:
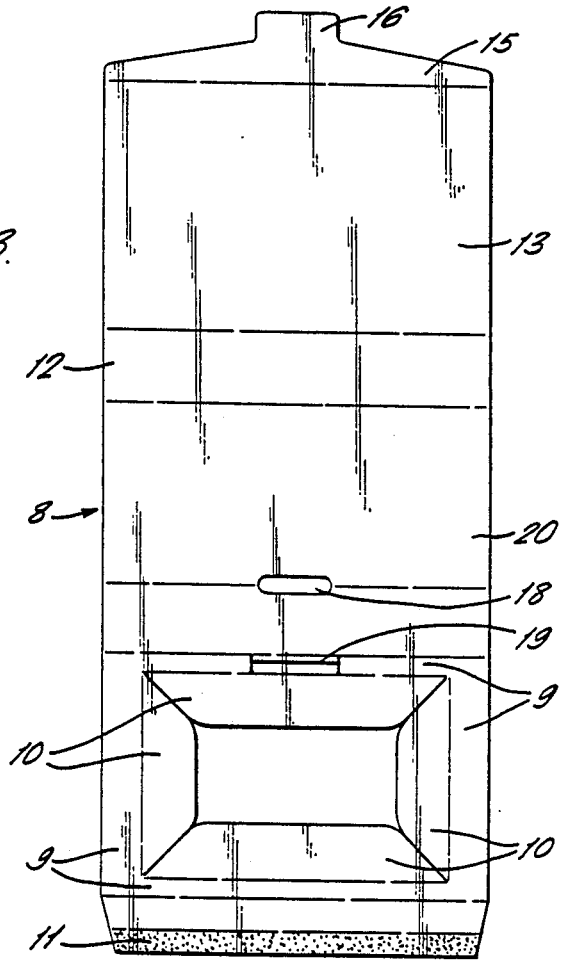
FIG. 3 is a plan view of the blank used to form the secondary package of the container of FIG. 1.
Figure 4:
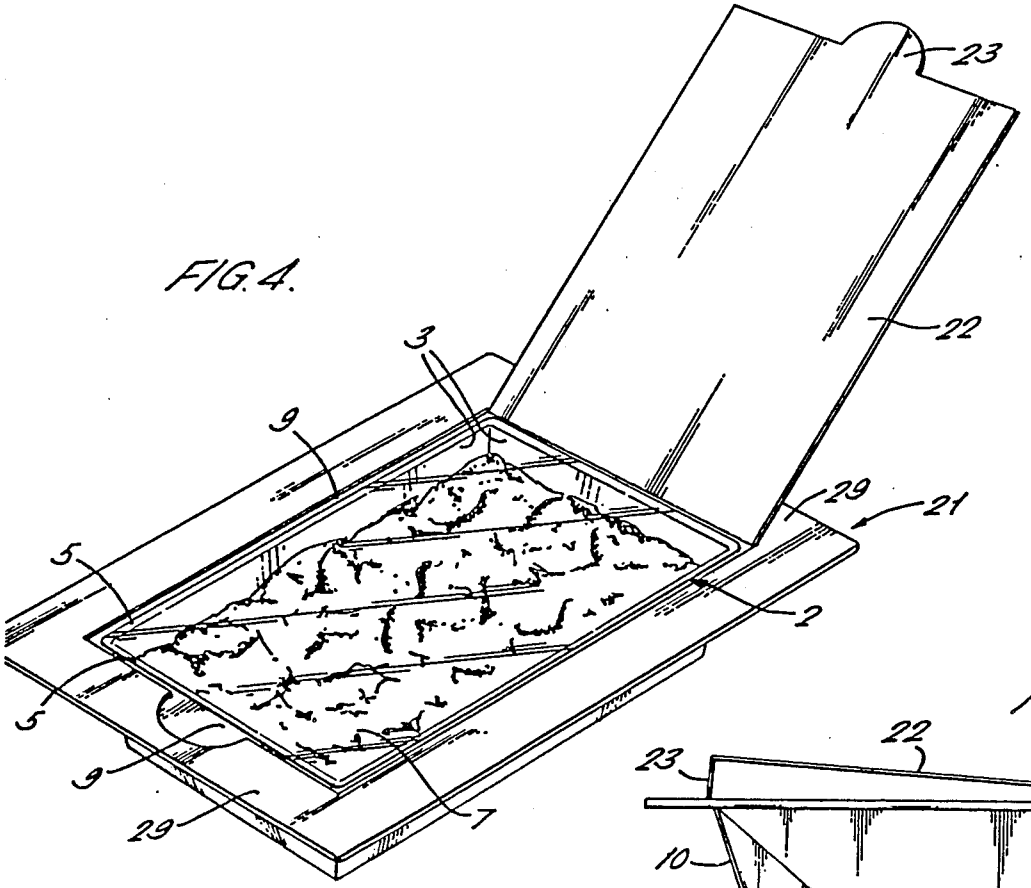
FIG. 4 is a perspective view of a second type of container of the present invention with a hinged lid in the open position.

To assemble the container shown with reference to FIGS. 4 to 6, the blank shown in FIG. 6 is taken. The tray 2 containing the ready prepared meal is inserted into the recess surrounded by portion 9, thereby causing flanges 10 to bend along crease lines 26 and to bear against the side walls 3 of the tray. With the tray in position the other half of the blank with the lid intact is folded thereover and the glued edges 27 are folded along crease lines 28 and glued to the underneath of the portion 9 surrounding the recess.

The double thickness ends 29 of the container can be conveniently used to carry the ready prepared meals to or from the oven.

In an alternative version of the secondary package shown in FIGS. 4 to 6, and as described above, the flanges 10 may be further extended and provided with appropriate crease lines so that the flanges not only bear against the side walls of the tray, but also extend underneath the base of the tray. The portions of the flanges which extend underneath the base of the tray are sufficient to avoid transfer of heat to the base of the tray by conduction from the oven shelf on which the tray is placed. The additional benefit of these extended flanges is that they provide heat resistance for fingers placed beneath the pack.

It will be understood that whilst the tray located in the secondary package as depicted in the Figures of the drawings is essentially rectangular, the invention is not limited in this respect and square or hexagonal trays, for example, as well as other shapes are included within the scope of the invention.

It will furthermore be understood that a single secondary package could be provided with two or more recesses each having an appropriate tray located therein. In this arrangement, the secondary package will support the underneaths of the rims of each of the trays and have appropriate flanges depending from the recesses which bear against the walls of the trays.

We claim:

1. A heat resistant container suitable for a ready prepared meal, which comprises a tray having a bottom, side walls, and a rim, said tray being located in a recess provided in a secondary package, at least a substantial portion of the rim thereby being supported by the portion of the secondary package surrounding said recess, said secondary package provided with a hinged lid which encloses the top surface of said tray, and said secondary package also having a plurality of flanges depending from the recess opening which bear upon the side wall of said tray.

2. A container as claimed in claim 1 wherein all of the rim of the tray is supported by the portion of the body of the secondary package surrounding the recess.

3. A container as claimed in claim 2 wherein the secondary package has two pairs of opposed flanges depending from the recess opening.

4. A container as claimed in claim 1 wherein the tray is made from a heat-resisting thermoplastics material.

5. A container as claimed in claim 4 wherein the heat-resisting thermoplastics material is polyester, polypropylene, polyethylene which has been exposed to high energy electron or electromagnetic irradiation, or a multilayer material.

6. A container as claimed in claim 1 wherein the secondary package is made from cardboard having a heat-resisting film coated thereon or bonded thereto.

7. A container as claimed in claim 6 wherein the heat-resisting film is a polyester or polyetherimide film.

8. A container as claimed in claim 1 wherein the secondary package is made from a foldable and heat resistant solid plastics material.

9. A container as claimed in claim 1 wherein the hinged lid is adapted to remain in the open position once the package has been opened.

10. A container as claimed in claim 1 wherein the hinged lid is provided with means to enable it to be locked into the secondary package to provide a splashguard which is raised above the top of the tray.

11. A container as claimed in claim 10 wherein the hinged lid has a toungue which locks into a slot formed in the secondary package.

12. A container as claimed in claim 11 wherein the secondary package has a base portion which surrounds the bottom of the tray.

13. A container as claimed in claim 12 wherein there is an air gap between the bottom of the tray and the base of the secondary package.

14. A container as claimed in claim 12 wherein the secondary package has open ends.

15. A container as claimed in claim 1 wherein the flanges which depend from the recess opening bear against the side walls of the tray and also extend underneath the base of the tray.

* * * * *